United States Patent [19]

Wagner et al.

[11] Patent Number: 4,810,625

[45] Date of Patent: Mar. 7, 1989

[54] PHOTOGRAPHIC MATERIAL WITH PYRAZOLONE COUPLER AND OIL FORMER

[75] Inventors: Klaus Wagner; Johannes Sobel; Fritz Nittel, all of Leverkusen, Fed. Rep. of Germany

[73] Assignee: Agfa-Gevaert Aktiengesellschaft, Leverkusen, Fed. Rep. of Germany

[21] Appl. No.: 38,658

[22] Filed: Apr. 15, 1987

[30] Foreign Application Priority Data

Apr. 25, 1986 [DE] Fed. Rep. of Germany ..... 3613974

[51] Int. Cl.[4] ..... G03C 7/38

[52] U.S. Cl. ..... 430/546; 430/545; 430/551

[58] Field of Search ..... 430/546, 551, 545

[56] References Cited

U.S. PATENT DOCUMENTS

| | | | |
|---|---|---|---|
| 3,765,897 | 10/1973 | Nittel | 430/546 |
| 3,880,665 | 4/1975 | Himmelmann | 430/623 |
| 4,003,748 | 1/1977 | Langen et al. | 430/546 |
| 4,378,425 | 3/1983 | Schnoring et al. | 430/546 |
| 4,379,836 | 4/1983 | Schnoring et al. | 430/546 |
| 4,419,441 | 12/1983 | Nittel et al. | 430/546 |
| 4,430,421 | 2/1984 | Van de Sande et al. | 430/546 |
| 4,490,460 | 12/1984 | Shimba et al. | 430/551 |

*Primary Examiner*—Richard L. Schilling

*Attorney, Agent, or Firm*—Connolly and Hutz

[57] ABSTRACT

Color photographic recording material which contain pyrazolone magenta couplers, in particular 3-acylaminopyrazolone magenta couplers, have increased stability to formaldehyde if a compound corresponding to formula (I) is used as oil former for the magenta couplers:

$$A[-(R^1)_l-L-(R^2)_m-B]_n \quad (I)$$

In the above formula,

A, B each denote a hydrocarbon group optionally substituted by COOH, OH or $NH_2$, at least one of the groups A and B being a bicyclic or tricyclic hydrocarbon group with at least 7 carbon atoms optionally substituted by COOH, OH or $NH_2$, $R^1$ and $R^2$ denote an alkylene group with 1 to 6 carbon atoms, L denotes CO—O, O—CO, CO—NH or NH—CO, l and m have the value 0 or 1 and n has the value 1 or 2.

1 Claim, No Drawings

PHOTOGRAPHIC MATERIAL WITH PYRAZOLONE COUPLER AND OIL FORMER

This invention relates to a colour photographic recording material having at least one light-sensitive silver halide emulsion layer in association with a pyrazolone magenta coupler and an oil former which stabilizes the pyrazolone magenta coupler to formaldehyde.

It is known to prepare colour photographic images by chromogenic development, i.e. by developing an imagewise exposed recording material containing at least one silver halide emulsion layer with suitable colour forming developer substances, so-called colour developers, in the presence of at least one colour coupler so that the oxidation product of developer substances which is formed in correspondence with the silver image reacts with the colour coupler to form a dye image. The colour developers used are generally aromatic compounds containing primary amino groups, in particular those of the p-phenylenediamine series. The colour couplers may be used in the form of solutions or, as in the present case, they may be contained in one or more layers of the colour photographic recording material.

The substances used as magenta couplers, i.e. colour couplers suitable for producing the magenta colour image, are generally compounds derived from pyrazolone-5.

When such magenta couplers are used, their reactivity with formalin is found increasingly to be a disadvantage. Formalin, which is present in traces in the atmosphere and in particular is released over long periods from wood or plastics used in the manufacture of furniture, presumably blocks the coupling position of these couplers, thereby adversely affecting the sensitivity and maximum colour density of the colour photographic recording materials. This effect is particularly serious when a colour photographic recording material containing such colour couplers is kept for long periods, either before or after exposure, in an environment containing formalin, e.g. in comparatively new plastics cupboards, before it is developed.

Various proposals have been made to overcome this disadvantage. One known attempt at a solution is based on the idea of reducing the reactivity of the magenta coupler by some means or another, e.g. by using a 2-equivalent coupler instead of the corresponding, more conventionally used 4-equivalent coupler, or by using the coupler in the enol form in which the enolic hydroxyl group is blocked by acylation, or by attaching the coupler in the enol form as releasable group to the coupling position of another coupler which yields colourless or alkali soluble products on development (Research Disclosure 19536, July 1980). The last-mentioned couplers are 6-equivalent couplers; two oxidation equivalents are required to release the magenta coupler as a releasable group from the other coupler and thereby activate it and a further four oxidation equivalents are required for the colour coupling reaction itself. This requires the application of a larger quantity of silver, which in itself is a disadvantage.

Another possibility of avoiding the disadvantages caused by aldehydes, in particular formaldehyde, lies in incorporating so-called aldehyde scavengers in the layers of the photographic recording material.

Thus, it is known from DE-AS No. 1 772 816, for example, to add, for example, N,N'-ethyleneurea, 2,3-dihydroxynaphthalene or Dimedon to photographic layers in order to fix formaldehyde. A photographic recording material which contains an acyclic urea as aldehyde scavenger in one of its colloid layers in addition to a vinyl sulphonyl hardener is described in DE-A-No. 2 332 426. In U.S. Pat. No. 3,652,278 is described a process for reducing the fog in photographic recording materials which are to be stored in an atmosphere containing formaldehyde. In this process, a compound from the group comprising N,N'-ethyleneurea, 2,3-dihydroxynaphthalene and 1,1-dimethyl-3,5-diketocyclohexane is incorporated in the silver halide emulsion.

According to U.S. Pat. No. 2,309,492, photographic recording materials containing an aldehyde hardener are processed in the presence of an organic compound which is capable of reacting with the aldehyde. Compounds of this kind include hydroxylamines, hydrazines, hydrazo compounds, semicarbazides, naphthalenediamines and dimethyldihydroresorcinol. U.S. Pat. No. 3,168,400 also relates to a process for stabilizing photographic images. In this process, the binder of the photographic recording material is hardened with an aldehyde after exposure but before development and the unused aldehyde is subsequently removed by treatment with the aqueous solution of an amine compound. Suitable amines are, for example, hydroxylamine, semicarbazide, hydrazine, biuret and aminoguanidine. According to DE-A-No. 2 227 144, photographic materials containing aldehydes are treated in baths containing hydroxylamine and/or a water-soluble salt of hydroxylamine and an aromatic polyhydroxyl compound containing two hydroxyl groups in the ortho-position, e.g. an o-dihydroxy compound from the benzene series.

According to another proposal, the damaging effect of formaldehyde on photographic layers is prevented by oxidation of the formaldehyde (DE-A-No. 3 227 962).

It is an object of the present invention to provide a photographic recording material having improved stability to the action of formaldehyde.

The present invention relates to a colour photographic recording material containing at least one light-sensitive silver halide emulsion layer with which a pyrazolone magenta coupler and an oil former for the pyrazolone magenta coupler are associated, characterised in that the oil former corresponds to the following general formula I $$A[-(R^1)_l-L-(R^2)_m-B]_n \qquad \text{I}$$

wherein

A, B denote each a hydrocarbon group optionally substituted by COOH, OH or $NH_2$, at least one of the groups A and B being a bicyclic or tricyclic hydrocarbon group with at least 7 carbon atoms optionally substituted by COOH, OH or $NH_2$, $R_1$ and $R^2$ denote an alkylene group with 1 to 6 carbon atoms, L denotes CO—O, O—CO, CO—NH or NH—CO, l and m have the value 0 or 1 and n has the value 1 or 2.

A bicyclic or tricyclic hydrocarbon group denoted by A and/or B may be, for example, a bicycloheptane, tricyclodecane or tricyclodecene group optionally substituted with methyl.

The oil formers according to the invention are carboxylic acid ester or carboxylic acid amide derivatives of bicyclic or tricyclic organic compounds containing one or two carboxyl, hydroxyl or amino groups. The aforesaid bicyclic or tricyclic hydrocarbon groups (A, B) are therefore attached to the carbon atoms of an ester or amidocarbonyl group, to the oxygen atom of an ester group or to the nitrogen atom of an amide group, in each case optionally through an alkylene connecting member ($R^1$, $R^2$). These compounds are advantageously, for example, acylation products of tricyclo[5.2.1.$0^{2,6}$]decane containing one or two hydroxymethyl groups or aminomethyl groups or corresponding derivatives of tricyclo[5.2.1.$0^{2,6}$]decene. These acylation products may advantageously also contain a carboxyl group.

Particularly preferred oil formers according to the present invention correspond to the following formula II $$\text{(TCD)}\left[-CH_2-Y-CO-\underset{\underset{HOCO-CH-R^4}{|}}{CH}-R^3\right]_n \qquad \text{II}$$

wherein

TCD denotes a n-valent tricyclo[5.2.1.$0^{2,6}$]decane group,

Y denotes O or NH, $R^3$ and $R^4$ denote H, alkyl or alkenyl with up to 20 carbon atoms or $R^3$ and $R^4$ together denote a group for completing a cyclohexane or cyclohexene ring, and n has the value 1 or 2.

TABLE 1

| OF- | A | B | n | L | $R^1$, $R^2$ | l | m |
|---|---|---|---|---|---|---|---|
| 1 | TCD | CENE | 1 | —O—CO— | —$CH_2$— | 1 | 0 |
| 2 | TCD | CANE | 1 | " | " | 1 | 0 |
| 3 | TCD | CENE | 2 | " | " | 1 | 0 |
| 4 | TCD | MCANE | 1 | " | " | 1 | 0 |
| 5 | TCD | MCANE | 2 | " | " | 1 | 0 |
| 6 | HMTCD | CANE | 1 | " | " | 1 | 0 |
| 7 | TCD | CANE | 2 | " | " | 1 | 0 |
| 8 | TCDene | CENE | 1 | " | — | 0 | 0 |
| 9 | TCDene | MCANE | 1 | " | — | 0 | 0 |
| 10 | TCDene | CANE | 1 | " | — | 0 | 0 |
| 11 | BCH | CANE | 1 | " | $C_6$ | 1 | 0 |
| 12 | BCH | MCANE | 1 | " | " | 1 | 0 |
| 13 | TCD | CANE | 2 | —NH—CO— | —$CH_2$— | 1 | 0 |
| 14 | TCD | MCANE | 2 | " | " | 1 | 0 |
| 15 | TCD | C-20-C | 1 | —O—CO— | " | 1 | 0 |
| 16 | TCD | CPh | 1 | " | " | 1 | 0 |
| 17 | BCH | CENE | 1 | " | $C_6$ | 1 | 0 |
| 18 | TCD | CANE | 1 | " | — | 0 | 0 |
| 19 | TCD | MCANE | 1 | " | — | 0 | 0 |
| 20 | TCD | C-14-C | 1 | " | — | 0 | 0 |
| 21 | MANE | TCD | 2 | —CO—O— | —$CH_2$— | 0 | 1 |
| 22 | 2-Ph | TCD | 2 | " | " | 0 | 1 |
| 23 | TCD | Ph | 2 | " | " | 0 | 1 |
| 24 | 4-Ph | TCD | 2 | " | " | 0 | 1 |
| 25 | TCD | TCD | 2 | —CO—NH— | " | 0 | 1 |
| 26 | TCD | BCH | 2 | —CO—O— | $C_6$ | 0 | 1 |
| 27 | TCD | ANE | 2 | —O—CO— | —$CH_2$— | 1 | 0 |
| 28 | TCD | C-7 | 1 | " | " | 1 | 0 |
| 29 | TCD | ANE | 1 | " | " | 1 | 0 |
| 30 | TCD | Ph | 1 | —CO—O— | " | 0 | 1 |
| 31 | BCH | Me | 1 | —O—CO— | $C_6$ | 1 | 0 |

The symbols in Table 1 have the following meanings:

| | |
|---|---|
| TCD | Tricyclo[5.2.1.$0^{2,6}$]decane |
| HMTCD | Hydroxymethyltricyclodecane |
| TCDene | Tricyclo[5.2.1.$0^{2,6}$]dec-3-ene |
| BCH | 2,2-Dimethylbicyclo[2.2.1]heptane |
| CANE | 2-Carboxycyclohexane |

-continued

| | |
|---|---|
| CENE | 2-Carboxycyclohex-4-ene |
| MCANE | 2-Carboxy-5-methylcyclohexane |
| MANE | 3(4)-Methylcyclohexane |
| ANE | Cyclohexane |
| Me | Methyl |
| Ph | Phenyl |
| 2-Ph | 2-Phenylene |
| 4-Ph | 4-Phenylene |
| CPh | 2-Carboxyphenyl |
| C-14-C | $C_{12}H_{23}-\underset{\underset{CH_2-}{\vert}}{CH}-COOH$ |
| C-20-C | $C_{18}H_{35}-\underset{\underset{CH_2-}{\vert}}{CH}-COOH$ |
| C-7 | $C_7H_{15}-$ |
| $C_6$ | $\text{+}CH_2\text{+}_2\underset{\underset{C_2H_5}{\vert}}{CH}-CH_2-$ |

The oil formers according to the invention may be prepared from suitable hydroxyl or amino compounds by acylation with the usual acylating agents such as acyl halides or preferably with dicarboxylic acid anhydrides. Suitable starting compounds for the preparation of the oil formers according to the invention are, for example, hydroxyl compounds, amino compounds and carboxyl compounds such as those marketed by Hoechst under the names TCD alcohol E, A, M, DM, TCD carboxylic acid D, DS and TCD-diamine.

The method of synthesis of two oil formers according to the invention is described below.

Preparation of Compound OF-4

2.520 g of 4-Methyl-hexahydrophthalic acid anhydride and 2.495 g of 3(4)-hydroxymethyl-tricyclo[5.2.1.$0^{2,6}$]decane are heated to 120° C. with the addition of 30 g of 1,4-diazabicyclo[2.2.2]-octane with stirring for 3 hours. The reaction mixture is then cooled to 80°–90° C. with further stirring and a 50% solution of Compound OF-4 is prepared by the addition of 5.015 g of diethylcarbonate.

Preparation of Compound OF-5

98 g of 3(4), 8(9)-Dihydroxymethyl-tricyclo[5.2.1.$0^{2,6}$]decane and 169 g of 4-methyl-hexahydrophthalic acid anhydride are heated to 130°–135° C. with the addition of 1.5 g of 1,4-diazabicyclo[2.2.2]octane with stirring for 4 hours. The reaction mixture is then cooled to 120° C. with further stirring and a 50% solution of Compound I,5 is prepared by the addition of 268 g of diethyl carbonate.

The other compounds according to the invention may be prepared analogously. Several compounds and their methods of preparation are also described in EP-A-No. 0 084 694.

The magenta couplers used according to the invention may be 3-anilino or 3-acylaminopyrazolones, preferably the latter. Preferred magenta couplers may correspond, for example, to the following general formula III

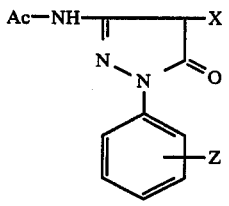

III wherein

Ac denotes an acyl group derived from an aliphatic or aromatic carboxylic or sulphonic acid, a carbamic or sulphamic acid or a carbonic acid monoester, Z denotes hydrogen or one or more substituents selected from halogen, alkyl, alkoxy, alkylthio, acylamino, alkylsulphonyl and sulphamoyl, and X denotes hydrogen or a group which can be released in the colour coupling reaction.

The acyl group denoted by Ac may be substituted, for example if it is an alkylcarbonyl or benzoyl group; the substituent may be halogen, OH, alkoxy, aroxyamino or acylamino for example.

The releasable group denoted by X may be, for example, a halogen atom, e.g. Cl, or an organic group which is generally attached at the coupling position of the coupler molecule through an oxygen, sulphur or nitrogen atom. If the releasable group is a cyclic group, it may be directly attached to the coupling position of the coupler molecule through an atom which forms part of a ring, e.g. a nitrogen atom or it may be attached indirectly through a connecting link. A large number of such releasable groups are known, e.g. as releasable groups of 2-equivalent magenta couplers.

Examples of releasable groups attached through oxygen correspond to the formula $$-O-R^4,$$

wherein $R^4$ denotes an acyclic or cyclic organic group, e.g. alkyl, aryl, a heterocyclic group or acyl which may be derived, for example, from an organic carboxylic or sulphonic acid. In particularly preferred releasable groups of this kind, $R^4$ is a substituted or unsubstituted phenyl group.

Examples of releasable groups attached through nitrogen are described in the following German Offenlegungsschriften (DE-A-): Nos. 2 536 191, 2 703 589, 2 813 522 and 3 339 201.

Many of these groups are 5-membered heterocyclic rings which are connected to the coupling position of the magenta coupler through a ring nitrogen atom. These heterocyclic rings frequently contain activating groups such as carbonyl or sulphonyl groups or double bonds in positions adjacent to the nitrogen atom through which they are attached to the coupler molecule.

A releasable group which is attached to the coupling position of the coupler through a sulphur atom may be the residue of a diffusible mercapto compound which is capable of inhibiting the development of silver halide. Such inhibitor groups have frequently been described as releasable groups attached to the coupling position of couplers, including magenta couplers, e.g. in U.S. Pat. No. 3,227,554.

The magenta coupler used according to the invention may be a polymeric compound obtained, for example, by homo- or copolymerisation of monomeric couplers corresponding to formula (III) containing an ethylenically unsaturated, copolymerisable double bond either in the group Ac or in a group Z or in the releasable group X. Couplers of this kind have been described, for example, in DE-A-No. 3 148 125, DE-A-No. 3 300 665, DE-A-No. 3 305 718 and Research Disclosure 25724 (September 1985).

The colour photographic recording material according to the invention contains at least one light-sensitive silver halide emulsion layer but preferably a sequence of several such light-sensitive silver halide emulsion layers, optionally with light-insensitive layers of binder arranged between them. According to the present invention, at least one of the light-sensitive silver halide emulsion layers present has a pyrazolone magenta coupler associated with it, emulsified with an oil former according to the present invention.

The oil former according to the invention may be used alone or together with other known oil formers but if the magenta coupler is dissolved in a mixture of oil formers then the mixture preferably contains more than 50% by weight of an oil former according to the present invention. When the pyrazolone magenta couplers are used in oil formers according to the invention, they are much less liable to be attacked by formaldehyde and this protective action is all the more pronounced the higher the proportion of oil former according to the invention in the mixture of oil formers used. This effect of the oil formers according to the invention is all the more surprising as these substances do not contain any formaldehyde reactive groups.

The oil formers are generally high boiling substances which have a good dissolving power for the couplers to be dispersed, in the present case pyrazolone magenta couplers, and are therefore also referred to as coupler solvents. They may be hydrophobic oil formers or oil formers in which the hydrophobic character is less pronounced due to the presence of hydrophilic groups such as hydroxyl or carboxyl groups and which should therefore be referred to as "hydrophilic" oil formers to distinguish them from the known hydrophobic oil formers. Esters of glutaric acid, adipic acid, phthalic acid, sebacic acid, succinic acid, maleic acid, fumaric acid, isophthalic acid, terephthalic acid and phosphoric acid, the esters of glycerol, paraffin and fluorinated paraffin are examples of hydrophobic oil formers which are preferred because they are chemically resistant, very readily accessible and easy to handle and dispersions of these oil formers used for photographic purposes have no deleterious effect on the light-sensitive materials. The following hydrophobic oil formers are particularly preferred for the purpose of this invention: Triarylphosphates such as tricresylphosphate, triphenylphosphate, dialkylphthalates such as dibutylphthalate, di-n-hexylphthalate, di-n-octylphthalate, di-n-nonylphthalate, di-n-dodecylphthalate, di-2-ethylhexylphthalate, glycerol tributyrate, glycerol tripropionate, dioctylsebacate, paraffin and fluorinated paraffin. The hydrophilic oil formers already mentioned above are also found to be particularly advantageous owing to their graduated hydrophobic character, e.g. monoesters of succinic acid carrying an aliphatic group with at least 8 carbon atoms in an $\alpha$-position of the succinic acid ester, and monoesters of phthalic acids or hydrogenated phthalic acids. Compounds of this kind are described in U.S. Pat. No. 3,689,271. Other suitable hydrophilic oil formers include phenols such as 2,4-ditertiary-amyl phenol, 2,4-dicyclopentylphenol and dodecylphenol as well as aliphatic and cycloaliphatic alcohols which have at least 10 carbon atoms and are not or only slightly steam volatile, e.g. hydroxymethyl derivatives of tricyclo[5.2.1.0$^{2,6}$]decane.

The halides in the light-sensitive silver halide emulsions used in the light-sensitive layers may be chloride, bromide, iodide or mixtures thereof. For example, the halide content of at least one layer may consist of 0 to 12 mol-% of iodide, 0 to 50 mol-% of chloride and 50 to 100 mol-% of bromide. In certain embodiments, the halides are predominantly compact crystals, e.g. cubic or octahedric or transitional forms. They may be characterised in that their thickness is mostly greater than 0.2 μm. Their average ratio of diameter to thickness is preferably less than 8:1, the diameter of a grain being defined as the diameter of a circle having a surface area equal to the projected surface area of the grain. In another embodiment, all or some of the emulsions may contain mainly tabular silver halide crystals in which the ratio of diameter to thickness is greater than 8:1. The emulsions may be heterodisperse or monodisperse emulsions, preferably with an average grain size of from 0.3 μm to 1.2 μm. The silver halide grains may also have a layered grain structure.

The emulsions may be chemically and/or spectrally sensitized in the usual manner and they may be stabilized with suitable additives. Suitable chemical sensitizers, spectral sensitizing dyes and stabilizers are described, for example, in Research Disclosure 17643 (December 1978), see in particular Chapters III, IV and VI.

The colour photographic recording material according to the invention preferably contains at least one silver halide emulsion layer for light of each of the three spectral regions red, green and blue. For this purpose, the light-sensitive layers are spectrally sensitized with suitable sensitizing dyes in known manner. Blue-sensitive silver halide emulsion layers need not necessarily contain a spectral sensitizer since the intrinsic sensitivity of the silver halide is in many cases sufficient for recording blue light.

Each of the above-mentioned light-sensitive layers may consist of a single layer or it may be composed in known manner of two or more silver halide emulsion partial layers, e.g. in a so-called double layer arrangement (DE-C-No. 1 121 470). Red-sensitive silver halide emulsion layers are usually arranged closer to the layer support than green-sensitive silver halide emulsion layers which in turn are arranged closer to the support than blue-sensitive layers, and a light-insensitive yellow filter layer is generally interposed between the green-sensitive layers and the blue-sensitive layers, although other arrangements could be used. A light-insensitive intermediate layer is generally arranged between layers of different spectral sensitivities. This intermediate layer may contain means for preventing accidental diffusion of developer oxidation products. When several silver halide emulsion layers of the same spectral sensitivity are used, these may be arranged adjacent to one another or they may be separated by a light-sensitive layer having a different spectral sensitivity (DE-A-No. 1 958 709, DE-A-No. 2 530 645, DE-A-No. 2 622 922).

Colour photographic recording materials according to this invention generally contain colour couplers for producing the different partial colour images, cyan, magenta and yellow, in spatial and spectral association with the silver halide emulsion layers of the different spectral sensitivities. In this arrangement, the pyrazolone magenta couplers dispersed with the oil formers according to the present invention are generally associated with a green-sensitive silver halide emulsion layer.

By "spatial association" is meant that the colour coupler is so situated in space in relation to the silver halide emulsion layer that the colour coupler and the emulsion layer are capable of interacting to enable an imagewise correspondence to be obtained between the silver image formed as a result of development and the colour image produced from the colour coupler. This is generally achieved by incorporating the colour coupler directly in the silver halide emulsion layer or in an adjacent layer of binder which may be insensitive to light.

By "spectral association" is meant that the spectral sensitivity of each of the light-sensitive silver halide emulsion layers and the colour of the partial colour image produced from the spatially associated colour coupler are in a certain relationship to one another, each of the spectral sensitivities (red, green, blue) having a different colour of the corresponding partial colour image (generally e.g. the colours cyan, magenta, and yellow in this sequence) associated therewith.

Each of the silver halide emulsion layers which are sensitized to different parts of the spectrum may be associated with one or more colour couplers. If several silver halide emulsion layers of the same spectral sensitivity are present, each of them may contain a colour coupler and these colour couplers need not necessarily be identical, provided only that they give rise at least approximately to the same color on colour development, normally a colour which is complementary to the colour of the light to which the associated silver halide emulsion layers are predominantly sensitive.

In preferred embodiments, therefore, red-sensitive silver halide emulsion layers have at least one non-diffusible colour coupler associated with them to produce the cyan partial colour image, generally a coupler of the phenol or α-naphthol series; green-sensitive silver halide emulsion layers have at least one non-diffusible colour coupler associated with them for producing the magenta partial colour image, optionally another magenta coupler, e.g. of the indazolone or pyrazoloazole series, in addition to the pyrazolone magenta coupler used according to the invention. Blue-sensitive silver halide emulsion layers have at least one non-diffusible colour coupler associated with them for producing the yellow partial colour image, generally a colour coupler containing an open chain ketomethylene group. Many colour couplers of this kind are known and have been described in numerous Patent Specifications; see, for example, the publications "Farbkuppler" by W. PELZ in "Mitteilungen aus den Forschungslaboratorien der Agfa, Leverkusen/München", Volume III, page 111 (1961) and the publication by K. Venkataraman in "The Chemistry of Synthetic Dyes", Vol. 4, 341 to 387, Academic Press (1971).

Both the colour couplers according to the invention and the other colour couplers present in the colour photographic recording material may be conventional 4-equivalent couplers or 2-equivalent couplers which require a smaller quantity of silver halide for colour production. 2-Equivalent couplers are derived, as is known, from 4-equivalent couplers in that their coupling position carries a substituent which is split off in the coupling reaction. The 2-equivalent couplers include both those which are virtually colourless and those which have an intense colour of their own which disappears in the process of colour coupling to be replaced by the colour of the resulting image dye. The last mentioned couplers may also be present as masking couplers in the light-sensitive silver halide emulsion layers to compensate for unwanted side densities in the image dyes. The 2-equivalent couplers also include the known white couplers which do not yield a dye when they react with colour developer oxidation products. Lastly, the 2-equivalent couplers include couplers in which the coupling position carries a removable group which is released in the reaction with colour developer oxidation products to produce a particular photographic effect, e.g. it may act as development inhibitor or accelerator. Examples of such 2-equivalent couplers include the known DIR couplers as well as the DAR and FAR couplers. The group which is released may also be a ballast group so that the reaction with colour developer oxidation products may give rise to coupling products, e.g. dyes, which are diffusible or at least have a slight or limited mobility.

By "slight or limited mobility" is meant a mobility of such a degree that the contours of the discrete dye patches formed on chromogenic development merge and become smudged. This degree of mobility should be distinguished from the usual complete immobility in photographic layers, which is normally desirable in colour couplers and the resulting dyes used in conventional photographic recording material in order that a very sharp image may be obtained and it should also be distinguished from the complete mobility of dyes which is required, for example, for the dye diffusion process. The slight mobility desired according to the invention may be controlled by varying the substituents, for example so as to influence the solubility in the organic medium of the oil former or the affinity to the binder matrix.

The usual layer supports are suitable for the recording materials according to the invention, e.g. supports of cellulose esters such as cellulose acetate or of polyesters. Paper supports are also suitable, and these may be coated, e.g. with polyolefines, in particular with polyethylene or polypropylene; see Research Disclosure 17643, Chapter XVII.

The usual hydrophilic film forming substances may be used as protective colloids or binders for the layers of recording material, e.g. proteins, in particular gelatine. Casting auxiliaries and plasticizers may be used. See Research Disclosure 17643, Chapters IX, XI and XII.

The layers of the photographic material may be hardened in the usual manner, for example with hardeners containing at least two reactive oxirane, aziridine or acryloyl groups. They may also be hardened by the process described in DE-A-No. 2 218 009. Furthermore, the photographic layers or the colour photographic multilayered materials may be hardened with hardeners of the diazine, triazine or 1,2-dihydroquinoline series or with hardeners of the vinyl sulphone type. Other suitable hardeners are known DE-A-No. 2 225 230, DE-A-No. 2 317 677, DE-A-No. 2 439 551 and Research Disclosure 17643, Chapter X. The stabilizing action of the oil formers according to the invention is particularly pronounced when hardeners which activate carboxyl groups are used, e.g. carbamoyl pyridinium salts or carbamoyl oxypyridinium salts.

Other suitable additives are mentioned in Research Disclosure 17643 and in "Product Licensing Index" of December 1971, pages 107–110.

Suitable colour developer substances for the material according to the invention include in particular those of the p-phenylenediamine series, e.g. 4-amino-N,N-diethylaniline hydrochloride, 4-amino-3-methyl-N-ethyl-N-β-(methanesulphonamido)-ethyl aniline sulphate hydrate, 4-amino-3-methyl-N-ethyl-N-β-hydroxyethyl aniline sulphate, 4-amino-N-ethyl-N-(2-methoxyethyl)-m-toluidine-di-p-toluene sulphonic acid and N-ethyl-N-β-hydroxyethyl-p-phenylenediamine. Other suitable colour developers are described, for example, in J.Amer.Chem.Soc. 73, 3100 (1951) and in G. Haist, Modern Photographic Processing, 1979, John Wiley and Sons, New York, pages 545 et seq.

After colour development, the material is bleached and fixed in the usual manner. Bleaching and fixing may be carried out separately or together. The usual bleaching agents may be used, e.g. $Fe^{3+}$ salts and $Fe^{3+}$ complex salts such as ferricyanides, dichromates, water-soluble cobalt complexes, etc. Iron-III complexes of aminopolycarboxylic acids are especially preferred, in particular, for example,of ethylene diaminotetracetic acid, nitrilotriacetic acid, iminodiacetic acid, N-hydroxyethyl-ethylenediaminotriacetic acid, alkylimino dicarboxylic acids and of corresponding phosphonic acids. Persulphates are also suitable bleaching agents.

EXAMPLE 1

A colour photographic recording material was prepared by applying the following layers in the sequence given to a transparent layer support of cellulose triacetate. The quantities refer to 1 $m^2$. The quantities of silver halide are given in terms of the corresponding quantities of $AgNO_3$. All the silver halide emulsions were stabilized with 0.5 g of 4-hydroxy-6-methyl-1,3,3a,7-tetraazaindene per 100 g of $AgNO_3$.

| | |
|---|---|
| Layer 1 | (Antihalation layer)<br>Black colloidal silver sol containing 1.5 g of gelatine and 0.33 g of Ag |
| Layer 2 | (Intermediate layer)<br>0.6 g of gelatine |
| Layer 3 | (Green-sensitized layer)<br>Green sensitized silver iodobromide emulsion (4 mol-% iodide; mean grain diameter 0.3 μm) obtained from 2.7 g of $AgNO_3$ with 1.9 g of magenta coupler M-1 emulsified in 0.35 times its quantity of oil former, and 2.8 g of gelatine. |
| Layer 4 | (Protective layer)<br>1.2 g of gelatine. |
| Layer 5 | (Hardening layer)<br>1.3 g of gelatine and 0.5 g of hardener corresponding to the following formula |

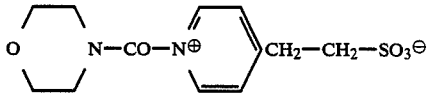

Four different versions of the recording material were prepared (Samples 1, 2, 3 and 4). These differed only in the nature of the oil former used in Layer 3.

In Sample 1, the oil former consisted entirely of OF-4.

In Sample 2, the oil former was composed of 2 parts by weight of OF-4 and 1 part by weight of tricresylphosphate (TKP).

In Sample 3, the oil former was composed of 1 part by weight of OF-4 and 2 parts by weight of TKP.

In Sample 4, the oil former consisted entirely of TKP.

Samples 1 to 4 prepared as described above were exposed to formaldehyde under specified conditions. They were stored at 23° C. and 70% relative humidity for periods of 3, 5, 7, 10 and 14 days in a refined steel vessel of 31 l capacity in which was placed in a dish containing 200 ml of a solution of 130 ml of glycerol, 1 ml of 30% aqueous formaldehyde solution and 69 ml of water.

After this treatment, each sample and an untreated comparison sample were developed by a conventional colour reversal development process, see Example 2 of EP-A-No. 62 202.

The maximum magenta colour density of the samples was measured and compared with the density of the untreated samples. It was clearly demonstrated that the stability to formaldehyde depended on the nature of the oil former used and that an improvement in the stability to formaldehyde can be obtained with the oil formers according to the invention. The results are entered in Table 2.

EXAMPLE 2

A colour photographic recording material containing Layers 1–5 was prepared as described in Example 1 but with the following Layer 3.

| | |
|---|---|
| Layer 3 | (green-sensitized layer)<br>Green-sensitized silver iodobromide emulsion (4 mol-% iodide; mean grain diameter 0.3 μm) from 2.8 g of $AgNO_3$ with 2.0 g of a coupler mixture of 90% magenta coupler M-1 and 10% magenta coupler M-2 emulsified in 0.45 times their quantity of oil former, and 3.0 g of gelatine. |

Four different versions of the recording material were prepared (Samples 5, 6, 7 and 8). These differed only in the nature of the oil former used in Layer 3.

In Sample 5, the oil former consisted entirely of OF-5.

In Sample 6, the oil former was composed of 1 part by weight of OF-5 and 1 part by weight of tricresylphosphate (TKP).

In Sample 7, the oil former was composed of 1 part by weight of OF-5 and 2 parts by weight of TKP.

In Sample 8, the oil former consisted entirely of TKP.

The method of treatment and processing was the same as in Example 1. The results are shown in Table 2.

TABLE 2

| | developable magenta density | | | | |
|---|---|---|---|---|---|
| | $D_{max}, t_o$ | $\frac{-\Delta D_{max}, t}{D_{max}, t_o} \cdot 100[\%]$ | | | |
| Sample | t = 0 | 0 | 3 | 5 | 7[d] |
| 1 | 3.20 | 0 | 14 | 24 | 29 |
| 2 | 3.22 | 0 | 21 | 29 | 33 |
| 3 | 3.16 | 0 | 23 | 30 | 41 |
| 4 | 3.44 | 0 | 42 | 68 | 84 |
| 5 | 3.38 | 0 | 8 | 17 | 21 |
| 6 | 3.29 | 0 | 11 | 20 | 26 |
| 7 | 3.67 | 0 | 18 | 30 | 35 |
| 8 | 3.55 | 0 | 34 | 65 | 74 |

The following couplers were used in Examples 1 and 2:

M-1

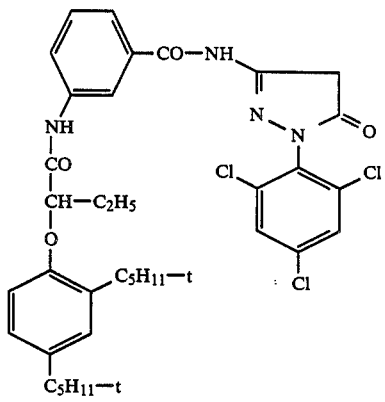

M-2

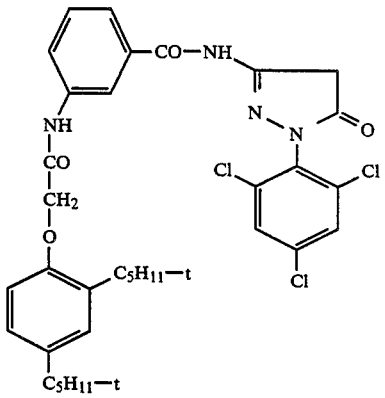

EXAMPLE 3

A colour photographic recording material for reversal colour development was prepared by applying the following layers in the given sequence to a transparent layer support of cellulose triacetate. The quantities are based on 1 $m^2$. The quantities of silver halide applied are given in terms of the corresponding quantities of $AgNO_3$. All the silver halide emulsions were stabilized with 0.5 g of 4-hydroxy-6-methyl-1,3,3a,7-tetraazaindene per 100 g of $AgNO_3$.

| | |
|---|---|
| Layer 1 | (Antihalation layer)<br>Black colloidal silver sol containing 1.5 g of gelatine and 0.33 g of Ag |
| Layer 2 | (Intermediate layer)<br>0.6 g of gelatine |
| Layer 3 | (1st red-sensitized layer)<br>Red-sensitized silver iodobromide emulsion (4 mol-% iodide; mean grain diameter 0.25 μm) from 1.3 g of $AgNO_3$ with 0.38 g of cyan coupler C-1 emulsified in 0.5 times its quantity of TKP, and 1.3 g of gelatine. |
| Layer 4 | (2nd red-sensitized layer)<br>Red-sensitized silver iodobromide emulsion (3 mol-% iodide; mean grain diameter 0.8 μm) from 2.0 g of $AgNO_3$ with 1.2 g of cyan coupler C-1 emulsified in 0.5 times its quantity of TKP, and 1.8 g of gelatine |
| Layer 5 | (Intermediate layer)<br>1.1 g of gelatine and 0.5 g of 2,5-diisooctylhydroquinone |
| Layer 6 | (1st green-sensitized layer)<br>Green-sensitized silver iodobromide emulsion (4 mol-% iodide; mean grain diameter 0.25 μm) from 1.3 g of $AgNO_3$ with 0.32 g of magenta coupler M-1 emulsified with 0.35 times its quantity of oil former, and 1.0 g of gelatine |

-continued

| | |
|---|---|
| Layer 7 | (2nd green-sensitized layer)<br>Green-sensitized silver iodobromide emulsion (3 mol-% iodide; mean grain diameter 0.8 μm) from 1.4 g of $AgNO_3$ with 1.16 g of magenta coupler M-1 emulsified in 0.35 times its quantity of oil former, and 1.35 g of gelatine |
| Layer 8 | (yellow filter layer)<br>Yellow colloidal silver sol containing 0.18 g of Ag and 1.0 g of gelatine and 0.3 g of 2,5-diisooctyl hydroquinone |
| Layer 9 | (1st blue-sensitive layer)<br>Blue-sensitized silver iodobromide emulsion (4 mol-% iodide; mean grain diameter 0.25 μm) from 0.5 g of $AgNO_3$ with 0.6 g of yellow coupler Y-1 emulsified with 0.5 times its quantity of TKP, and 0.75 g of gelatine |
| Layer 10 | (2nd blue-sensitive layer)<br>Blue-sensitized silver iodobromide emulsion (3 mol-% iodide; mean grain diameter 0.8 μm) from 1.15 g of $AgNO_3$ with 1.35 g of yellow coupler Y-1 emulsified with 0.5 times its quantity of TKP, and 1.6 g of gelatine |
| Layer 11 | (3rd blue sensitive layer)<br>Blue-sensitized silver iodobromide emulsion (4 mol-% iodide; mean grain diameter 0.03 μm) from 0.2 g of $AgNO_3$ with 0.8 g of a conventional UV absorbent, and 0.8 g of gelatine |
| Layer 12 | (Protective layer)<br>0.7 g of gelatine |
| Layer 13 | (Hardening layer)<br>1.5 g of gelatine and 0.7 g of the hardener described in Example 1. |

Four different versions of the recording material were prepared (Samples 9, 10, 11 and 12). These differed only in the nature of the oil former used in Layers 6 and 7.

In Sample 9, the oil former consisted entirely of OF-4.

In Sample 10, the oil former was composed of 1 part by weight of OF-4 and 1 part by weight of tricresyl phosphate (TKP).

In Sample 11, the oil former consisted of 1 part by weight of OF-4 and 2 parts by weight of TKP.

In Sample 12, the oil former consisted entirely of TKP.

The method of treatment and processing was the same as in Example 1.

The results (stability of the magenta coupler) are entered in Table 3.

The following couplers were used (see also Examples 1 and 2).

EXAMPLE 4

A colour photographic material containing layers 1 to 13 was prepared as described in Example 3 but Layers 6 and 7 were altered as follows:

| | |
|---|---|
| Layer 6 | (1st green-sensitized layer)<br>Green-sensitized silver iodobromide emulsion (4 mol-% iodide; mean grain diameter 0.25 μm) from 1.3 g of $AgNO_3$ with 0.32 g of a coupler mixture of 90% magenta coupler M-1 and 10% magenta coupler M-2 emulsified with 0.45 times the quantity of oil former, and 1.0 g of gelatine. |
| Layer 7 | (2nd green-sensitized layer)<br>Green-sensitized silver iodobromide emulsion (3 mol-% iodide; mean grain diameter 0.8 μm) from 1.4 g of $AgNO_3$ with 1.12 g of a coupler mixture of 90% magenta coupler M-1 and 10% magenta coupler M-2 emulsified with 0.45 times its quantity of oil former, and 1.3 g of gelatine. |

Four different versions of the recording material were prepared (Samples 13, 14, 15 and 16). These differed only in the nature of the oil former used in Layers 6 and 7.

In Sample 13, the oil former consisted entirely of OF-5.

In Sample 14, the oil former was composed of 1 part by weight of OF-5 and 1 part by weight of tricresylphosphate (TKP).

In Sample 15, the oil former was composed of 1 part by weight of OF-5 and 2 parts by weight of TKP.

In Sample 16, the oil former consisted entirely of TKP.

Treatment and processing were the same as in Example 3.

The results (stability to formaldehyde determined from the developable magenta density) are entered in Table 3.

TABLE 3

| | developable magenta density | | | | | | |
|---|---|---|---|---|---|---|---|
| | | $\frac{-\Delta D_{max}, t}{D_{max}, t_o} \cdot 100[\%]$ | | | | | |
| Sample | $D_{max}, t_o$ t = 0 | 0 | 3 | 5 | 7 | 10 | 14[d] |
| 9 | 3.32 | 0 | | 6 | 12 | 12 | 21 |
| 10 | 3.43 | 0 | | 8 | 12 | 22 | 32 |
| 11 | 3.28 | 0 | | 12 | 15 | 29 | 40 |
| 12 | 3.23 | 0 | | 28 | 34 | 64 | 68 |

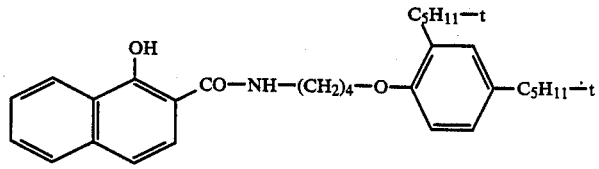

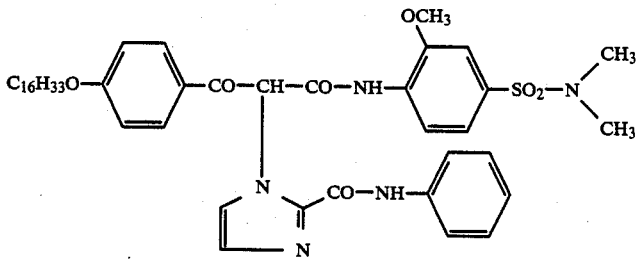

TABLE 3-continued

| | developable magenta density | | | | | | |
|---|---|---|---|---|---|---|---|
| | $D_{max}$, $t_o$ | $\frac{-\Delta D_{max}, t}{D_{max}, t_o} \cdot 100[\%]$ | | | | | |
| Sample | t = 0 | 0 | 3 | 5 | 7 | 10 | 14[d] |
| 13 | 3.42 | 0 | 1 | 3 | 2 | 6 | 16 |
| 14 | 3.35 | 0 | 3 | 2 | 6 | 9 | 21 |
| 15 | 3.47 | 0 | 3 | 9 | 9 | 16 | 29 |
| 16 | 3.38 | 0 | 9 | 25 | 32 | 56 | 69 |

EXAMPLE 5

Colour photographic recording materials containing layers 1 to 5 were prepared by the methods described for Samples 5 and 8 in Example 2 but with the following difference:

Layer 5 contained 0.25 g of a hardener corresponding to the following formula $$CH_2{=}CH{-}SO_2{-}CH_2{-}SO_2{-}CH{=}CH_2$$

instead of the hardener used in Example 2.

Samples 17 and 18 thus obtained were treated and processed as described in Example 1.

In Table 4, the results obtained are compared with the results of Samples 5 and 8.

TABLE 4

| | developable magenta density | | | | |
|---|---|---|---|---|---|
| | $D_{max}$, $t_o$ | $\frac{-\Delta D_{max}, t}{D_{max}, t_o} \cdot 100[\%]$ | | | |
| Sample | t = 0 | 0 | 3 | 5 | 7[d] |
| 5 | 3.38 | 0 | 8 | 17 | 21 |
| 17 | 3.05 | 0 | 5 | 11 | 14 |
| 8 | 3.55 | 0 | 34 | 65 | 74 |
| 18 | 3.18 | 0 | 21 | 39 | 55 |

We claim:

1. A colour photographic recording material which has been hardened with a hardener which activates carboxyl and comprises at least one light-sensitive silver halide emulsion layer with which a pyrazolone magenta coupler and an oil former for the pyrazolone magenta coupler are associated, the oil former for the pyrazolone magenta coupler being an acylation product of tricyclo [5,2,1,$0^{2,6}$]decane containing one or two hydroxymethyl groups and corresponds to the following formula

II wherein (TCD) denotes a n-valent tricyclo [5,2,1,$0^{2,6}$]decane group,

Y denotes O, $R^3$,$R^4$ denotes H, alkyl or alkenyl with up to 20 carbon atoms or $R^3$ and $R^4$ together form a group for completing a cyclohexane or cyclohexene ring, and n has the value 1 or 2;

and the pyrazolone magenta coupler is a 3-acylaminopyrazolone of the following formula III

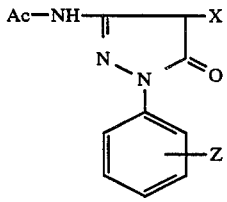

III wherein

Ac denotes an acyl group derived from an aliphatic or aromatic carboxylic or sulphonic acid, a carbamic or sulphamic acid group or a carbonic acid monoester, Z denotes hydrogen or one or more substituents selected from halogen, alkyl, alkoxy, alkylthio, acylamino, alkylsulphonyl and sulphamoyl, and X denotes hydrogen or a group which can be released in the colour coupling reaction.

* * * * *